US005738738A

United States Patent [19]

Yoon et al.

[11] Patent Number: 5,738,738

[45] Date of Patent: Apr. 14, 1998

[54] METHOD FOR MANUFACTURING A COLD ROLLED STEEL SHEET WITH EXCELLENT ENAMEL ADHERENCE

[75] Inventors: Jeong Bong Yoon; Sung Ju Kim, both of Pohang City, Rep. of Korea

[73] Assignees: Pohang Iron & Steel Co., Ltd.; Research Institute of Industrial Science & Technology, both of Pohang, Rep. of Korea

[21] Appl. No.: 693,114

[22] PCT Filed: Dec. 19, 1995

[86] PCT No.: PCT/KR95/00167

§ 371 Date: Aug. 19, 1996

§ 102(e) Date: Aug. 19, 1996

[87] PCT Pub. No.: WO96/19305

PCT Pub. Date: Jun. 27, 1996

[30] Foreign Application Priority Data

Dec. 20, 1994 [KR] Rep. of Korea ..... 1994-35202

[51] Int. Cl.[6] ..... C21D 8/02

[52] U.S. Cl. ..... 148/603; 148/651

[58] Field of Search ..... 148/603, 651

[56] References Cited

U.S. PATENT DOCUMENTS

| | | | |
|---|---|---|---|
| 3,761,324 | 9/1973 | Elias et al. | 148/36 |
| 3,928,083 | 12/1975 | Gondo et al. | 148/12 |
| 5,292,383 | 3/1994 | Osawa et al. | 148/330 |

FOREIGN PATENT DOCUMENTS

| | | | |
|---|---|---|---|
| 403267321 | 11/1991 | Japan | 148/603 |
| 406073457 | 3/1994 | Japan | 148/603 |

*Primary Examiner*—Deborah Yee

*Attorney, Agent, or Firm*—Webb Ziesenheim Bruening Logsdon Orkin & Hanson, P.C.

[57] ABSTRACT

A method for manufacturing a cold rolled steel plate used for enamel applications such as tableware, construction panel, external plate material of microwave oven and gas range, and bathtub, in which an excellent enamel adherence between an enamel layer and a raw steel plate is increased and a formability required for the production of complicated shape is greatly improved and to provide a method for manufacturing a high processing cold rolled steel plate being excellent in enamel adherence. The invention is, in a method for manufacturing an enamel coating cold rolled steel plate by utilizing aluminum killed steel, a method for manufacturing a high processing cold rolled steel plate being excellent in enamel close adhering property in which an aluminum killed steel, in which C: less than 0.01%, Mn: 0.1–0.4%, S: 0.03–0.09%, Ti: 0.04–0.1% and N: less than 0.01% by weight % are contained, and an atomic ratio defined by Ti/(C+N+0.4S) is adjusted to 1.0–2.0, and the remaining part consisting of Fe and other inevitable impurities is included, is hot rolled by making a finish rolling to be finished in a temperature section above the $Ar_3$ transformation temperature, then coiled and afterwards, cold rolled with a reduction ratio of 50–85%, and finally continuously annealed.

6 Claims, No Drawings

METHOD FOR MANUFACTURING A COLD ROLLED STEEL SHEET WITH EXCELLENT ENAMEL ADHERENCE

TECHNICAL FIELD

The present invention relates to a method for manufacturing a cold rolled steel plate used for enamel applications such as a part of microwave oven, gas range, bathtub and interior or exterior panels of building, and more particularly to a method for manufacturing a cold rolled steel plate which never occur fishscale defect being a fatal defect of the enamel coated product, and particularly excellent in an enamel adherence, and suitable for the enamel coated product having a complicated shape.

BACKGROUND ART

Heretofore, in manufacturing an cold rolled steel plate used for the enamel coated product, it has been mainly striven for preventing a fishscale defect by adding a titanium, boron and oxygen into the steel whereby precipitates such as titanium sulfides, titanium nitrides, titanium carbides, boron nitrides or manganese oxide.

These conventional steels have respectively advantages and disadvantages, for instance, in case of titanium added steel, a formability is excellent whereby a manufacturing of the product of complicated shape is easy, but an enamel adherence is more inferior than other steels, and in case of boron added steel, the enamel adherence is excellent, but it has not good formability and anti-fishscale property is more inferior.

And, in case of high oxygen added steel, the enamel adherence is also good but the formability and anti-fishscale property are more inferior, and since an oxygen is added much in the steel, it is easy to occur various surface defects.

DISCLOSURE OF INVENTION

Therefore, the present invention is proposed so as to improve such disadvantages of above described conventional steels, and it is an object of the present invention to provide a method for manufacturing a cold rolled steel plate which has an excellent enamel adherence greatly improved the formability required for a product of complicated shape.

BEST MODE FOR CARRYING OUT THE INVENTION

Hereinafter, the present invention will be described more in detail.

The present invention is a method in which, in a method for manufacturing a cold rolled steel plate by utilizing an aluminum killed steel, by weight %, C: less than 0.01%, Mn: 0.1–0.4%, S: 0.03–0.09%, Ti: 0.04–0.1%, N: less than 0.01%, are contained, atomic ratio defined by Ti/(C+N+0.4S) is 1.0–2.0, and remaining part is Fe and other inevitable impurities are included, and hot rolled so as to be finished more than $Ar_3$ transformation temperature in a finish rolling, and coiled, and then cold rolled by a reduction ratio of 50–85%, and then continuously annealed, whereby a cold rolled steel plate with excellent enamel adherence is obtained.

Hereinafter, numerical value limiting reasons for composition of the present invention will be described more in detail.

In the present invention, in case when a content of carbon is more than 0.01 weight % (hereinafter, just called as '%'), since an amount of solute carbon in the steel is much, a development of texture is obstructed during annealing or an amount of fine titanium carbide is much in order to fix solute carbon as titanium carbide, and thereby ferrite grain is to be fine, and since the formability becomes greatly lowered, the content amount of said carbon is desirable to limit to less than 0.01%.

Said manganese is an element to be added for an object that sulfur is precipitated as a manganese sulfide and to prevent a hot shortness as well as for improving the anti-fishscale property by producing microvoids upon cold rolling by precipitating the manganese sulfide during hot rolling. However, in case when an adding amount of the manganese is less than 0.1%, there is a worry of hot shortness by a sulfur existing in a solid solution state, and in case when the content amount of the manganese is more than 0.4%, an amount of solid solution manganese and number of manganese sulfide become much whereby a recrystallization growth is suppressed upon annealing and thereby the formability is greatly deteriorated, therefore the content amount of said manganese is desirable to limit to 0.1–0.4%. Thus, in 0.1–0.4% section of content amount of the manganese, an amount of manganese compound is sufficient whereby the anti-fishscale property can be sufficiently secured, and there is no worry about hot shortness by completely precipitating the sulfur remaining in a solid solution state.

Above described sulfur is generally known as an element disturbing a physical property of the steel, but in the present invention, it is an element to be added for utilizing an advantage improving a enamel adherence between the enamel layer and the steel plate. Its reason is not clearly known, however since the enamel adherence is greatly improved in case when the content amount of the sulfur is more than 0.03%, its lower limit value is limited to 0.03%, and in case when its content amount is more than 0.09%, there would be a worry about hot shortness by solid solution sulfur, and since the formability is deteriorated due to the precipitation of too much manganese sulfide, its upper limit value is desirable to select to 0.09%.

Preferable content amount of the sulfur is 0.06–0.08%.

Above described titanium is an element improving the formability of raw steel plate, however in case when its adding amount is less than 0.04%, since an amount of the titanium precipitation advantageously operating to a formability improvement is little, the formability is lowered, and when more than 0.1% is added, an amount of the titanium precipitates is too much and the recrystallization grain size becomes very fine, and since the formability becomes lowered, the adding amount of said titanium is desirable to limit to 0.04–0.1%.

Preferable content amount of the titanium is 0.06–0.08%.

Above described nitrogen is advantageous as its content amount is less, and when its content amount is more than 0.01%, a solid solution nitrogen becomes much or a titanium nitrides become much whereby the formability becomes lowered, therefore the content of said nitrogen is desirable to limit to less than 0.01%.

On the other hand, Ti/(C+N+0.4S) atomic ratio is limited to 1.0–2.0.

In case when said atomic ratio is less than 1.0, a carbon and nitrogen in the steel can not completely precipitated to precipitates and remained to a solid solution state in the steel, and the solid solution carbon or nitrogen disturbs a development of recrystallized texture advantageous to the formability upon annealing whereby the formability becomes lowered, and in case of more than 2.0, much quantity of titanium becomes remained in a solid solution state in the steel, and since the enamel adherence is greatly deteriorated, said Ti/(C+N+0.4S) atomic ratio is desirable to limit to 1.0–2.0.

That is, within a range that Ti/(C+N+0.4S) atomic ratio is 1.0–2.0, the carbon and the nitrogen are completely precipitated by the titanium, and the carbon or the nitrogen remaining in a solid solution form is almost nothing whereby the formability becomes greatly improved, and almost of titanium is existed in an precipitation state whereby the enamel adherence becomes better.

In above described atomic ratio expression, for the 0.4S term, almost of added sulfur is precipitated to a manganese sulfide or titanium sulfide, and as a result of observing at an electronic microscope, since about 40% of precipitated sulfur precipitates was titanium sulfides, this is considered.

Hereinafter, a manufacturing condition of the steel of the present invention will be described.

In the present invention, a steel slab composed as above should be hot rolled, at this moment, finish rolling temperature should be limited to more than $Ar_3$ transformation temperature.

In case when said hot finish rolling temperature is less than $Ar_3$ transformation temperature, since a development of {111} texture is disturbed due to a generation of elongated grain, the formability is lowered.

Thus, the hot rolled hot rolling steel plate is coiled by an ordinary method and then the cold rolling is executed, at this moment, the cold reduction ratio is desirable to limit to 50–85%.

Above described coiling temperature is desirable at about 600°–700° C.

The reason is because microvoids are produced in a process in which the precipitates precipitated upon hot rolling and being grown is broken or extended and stretched through the cold rolling process, and the microvoids remain almost as they are after annealing whereby operate as an important hydrogen absorbing source, in case when the cold reduction ratio is less than 50%, a generation of microvoids is little whereby hydrogen absorbing capacity is deteriorated and the fishscale occurring probability is high, and in case of rolling at a cold reduction ratio of more than 85%, the reduction ratio is too high whereby the microvoids are pressed and adhered, and since an area of microvoids is rather decreased, the hydrogen absorbing capacity becomes abruptly decreased. Accordingly, in case of cold rolling at a cold reduction ratio of 50–85%, since a sufficient hydrogen absorbing capacity can be ensured, the fishscale defect is not occurred.

Thus, the cold rolled steel plate is continuously annealed by an ordinary method, so that a high processing cold rolled steel plate being excellent in enamel adherence is manufactured.

Above described continuous annealing temperature is desirable at 800°–850° C., and the continuous annealing time is desirable for 30 seconds–10 minutes, and preferable continuous time is 1–5 minutes.

Hereinafter, the present invention will be concretely described through examples.

EXAMPLE

Steel slabs of invented steel, comparative steel and conventional steel having compositions as following table 1 were respectively maintained at 1250° C. heating furnace for one hour and then hot rolling was executed. At this moment, the hot finish rolling temperature was 900° C., and a coiling temperature was 650° C. Next, the hot rolled steel plates being hot rolled as above were cold rolled at 40–70% of cold reduction ratio as in following table 1, and then continuously annealed at 830° C.

TABLE 1

| kind of steel | chemical compositions (weight %) C | Mn | P | S | Ti | N | Ti/(C + N + 0.4S) atomic ratio | cold reduction ratio (%) |
|---|---|---|---|---|---|---|---|---|
| Invented steel: | | | | | | | | |
| 1 | 0.0015 | 0.15 | 0.010 | 0.045 | 0.062 | 0.0030 | 1.43 | 70 |
| 2 | 0.0024 | 0.24 | 0.012 | 0.062 | 0.071 | 0.0024 | 1.29 | " |
| 3 | 0.0033 | 0.20 | 0.008 | 0.079 | 0.080 | 0.0022 | 1.17 | " |
| 4 | 0.0024 | 0.30 | 0.015 | 0.050 | 0.060 | 0.0015 | 1.34 | " |
| 5 | 0.0024 | 0.24 | 0.012 | 0.062 | 0.071 | 0.0024 | 1.29 | 55 |
| 6 | 0.0024 | 0.24 | 0.012 | 0.062 | 0.071 | 0.0024 | 1.29 | 80 |
| Comparative steel: | | | | | | | | |
| 7 | 0.0172 | 0.20 | 0.010 | 0.020 | 0.152 | 0.0060 | 1.50 | 70 |
| 8 | 0.0053 | 0.25 | 0.010 | 0.008 | 0.042 | 0.0030 | 1.16 | " |
| 9 | 0.0057 | 0.25 | 0.010 | 0.060 | 0.032 | 0.0030 | 0.46 | 40 |
| 10 | 0.0033 | 0.05 | 0.010 | 0.080 | 0.050 | 0.0040 | 0.67 | 70 |
| 11 | 0.0041 | 0.20 | 0.008 | 0.059 | 0.010 | 0.0022 | 0.17 | " |
| 12 | 0.0015 | 0.25 | 0.012 | 0.035 | 0.088 | 0.0012 | 2.83 | " |
| 13 | 0.0030 | 0.25 | 0.015 | 0.040 | 0.095 | 0.0021 | 2.20 | " |
| 14 | 0.0070 | 0.25 | 0.015 | 0.069 | 0.055 | 0.0040 | 0.66 | " |
| 15 | 0.0085 | 0.15 | 0.015 | 0.085 | 0.060 | 0.0038 | 0.61 | " |
| Conventional steel: | | | | | | | | |
| 16 | 0.0039 | 0.15 | 0.010 | 0.013 | 0.122 | 0.0075 | 2.48 | " |

Test piece finished with annealing as above was fat-removed, and then deposited at 70° C. and 10% sulfuric acid solution for 5 minutes and an acid washing was executed, and rinsed by warm water and then deposited to neutralization solution of 3.6 g/l sodium carbide+1.2 g/l borax for 10 minutes. Test piece was coated enamel (M-type, made by Haekwang of Korea). The test piece finished a drying was fired at 830° C. for 7 minutes and then air cooled whereby an enamel coating process was completed. At this moment, an environmental condition of the firing furnace was made to a dew point temperature of 30° C., and this was a severe condition that the fishscale defect may be most easily occurred. The test piece finished with enamel coating process was maintained at 200° C. for 20 hours as a fishscale acceleration process and then the fishscale defect number occurred at 60 mm width by 200 mm length was checked by naked eyes, and its result is illustrated at following table 2. And, in order to evaluate an enamel adherence, PEI adherence index was measured by utilizing PEI adherence tester (tested by ASTM C313-59 reapproved 1972), and mechanical properties were measured for each test piece, and its result is illustrated at following table 2.

TABLE 2

| kind of steel | fish-scale defect arising number | enamel properties: enamel layer thickness | PEI index | yield strength (kg/mm$^2$) | mechanical properties: tensile strength (kg/mm$^2$) | elongation (%) | $\bar{r}$* |
|---|---|---|---|---|---|---|---|
| Invented steel: | | | | | | | |
| 1 | 0 | 110 μm | 98 | 13.7 | 30.8 | 59.2 | 2.39 |
| 2 | 0 | 104 μm | 99 | 14.3 | 31.2 | 50.6 | 2.22 |
| 3 | 0 | 109 μm | 97 | 14.9 | 31.5 | 48.9 | 2.18 |
| 4 | 0 | 98 μm | 100 | 13.5 | 30.1 | 53.9 | 2.45 |
| 5 | 0 | 94 μm | 98 | 13.5 | 29.8 | 52.5 | 2.12 |
| 6 | 0 | 114 μm | 96 | 14.8 | 32.0 | 50.5 | 2.38 |
| Comparative steel: | | | | | | | |
| 7 | 0 | 105 μm | 67 | 28.6 | 39.2 | 34.8 | 1.57 |
| 8 | 85 | 103 μm | 75 | 12.1 | 28.8 | 53.8 | 2.08 |
| 9 | 58 | 109 μm | 98 | 23.5 | 29.5 | 45.2 | 1.88 |
| 10 | 22 | 106 μm | 95 | 19.5 | 29.0 | 44.9 | 1.92 |
| 11 | 15 | 99 μm | 100 | 29.2 | 29.4 | 47.9 | 1.72 |
| 12 | 2 | 108 μm | 72 | 13.5 | 30.0 | 48.2 | 2.11 |
| 13 | 0 | 106 μm | 75 | 14.1 | 30.4 | 46.8 | 2.21 |
| 14 | 0 | 110 μm | 92 | 19.3 | 31.5 | 43.2 | 1.69 |
| 15 | 0 | 115 μm | 96 | 18.9 | 31.2 | 44.5 | 1.61 |
| Conventional steel: | | | | | | | |
| 16 | 2 | 107 μm | 55 | 17.2 | 32.4 | 44.9 | 1.92 |

*$\bar{r}$: Lank ford value

As illustrated in above table 2, in case of invented steels 1–6 in accordance with ranges of the present invention, the PEI index is more than 96 whereby very excellent enamel adherence is exhibited, and even in most severe condition, a generation of fishscale defect being a fatal defect of the enamel coating is nothing, and a yield strength is less than 15 kg/mm$^2$, $\bar{r}$ value is more than 2.1, and an elongation is more than 48%, therefore it has a mechanical property capable of very easily working almost of all enamel coating products including a bathtub.

On the other hand, in case of comparative steel 7, since the carbon content is higher than the present invention, the $\bar{r}$ value is 1.57 and the formability is low, and the enamel adherence is 67 and exhibits very low level, and this is because the content of sulfur is lower than a range of the present invention. And, in case of comparative steel 8, since the carbon, titanium and Ti/(C+N+0.4S) atomic ratio are suitable, the formability is 2.08 in $\bar{r}$ value and exhibits excellent level, but since the content of the sulfur is lower than the range of the present invention, the number of the fishscale is 85, and the enamel adherence is 75, therefore the enamel adherence is bad. And, in case of comparative steel 9, since the content of the sulfur is sufficient, the enamel adherence is 98 and exhibits very excellent level, but since the cold reduction ratio is 40% and lower than the range of the present invention, the amount of microvoids produced upon the cold working is less whereby 58 of fishscale defects are occurred, and since Ti/(C+N+0.4S) atomic ratio is also less than 1.0, the solid solution carbon or nitrogen could not completely fixed, and therefore the $\bar{r}$ value is 1.88 and exhibits a low formability.

And, in case of comparative steel 10, the content of sulfur is sufficient and the enamel adherence index is 95 and exhibits very excellent enamel adherence, but since the content of manganese is lower than a range of the present invention, sufficient amount of manganese sulfide could not be produced and the fishscale defect is produced by 22, and therefore bad enamel coating property is exhibited. And, in case of comparative steel 11, the content of sulfur and manganese is sufficient and the enamel adherence index is 100 and very excellent, but since not only the content of titanium is low but also Ti/(C+N+0.4S) atomic ratio is 0.17 and exhibits low, the $\bar{r}$ value is 1.72 and the formability is low and the amount of titanium precipitates is little, and therefore the fishscale defect has occurred by 15.

And, in case of comparative steel 12 to comparative steel 15, the range of contents of the adding elements belongs within a range of the present invention, but since Ti/(C+N+0.4S) atomic ratio is departed from a range of the present invention, therefore the enamel adherence is very bad or the formability becomes low.

That is, in case of comparative steel 12 and the comparative steel 13, the Ti/(C+N+0.4S) atomic ratios are respectively 2.83 and 2.20 and exhibit high and the formability is excellent, but PEI indexes are respectively 72 and 75, and therefore the enamel adherence is very bad.

And, in case of comparative steels 14 and 15, the atomic ratios are respectively 0.88 and 0.83 and exhibit low and the enamel adherence is good, but $\bar{r}$ values are respectively 1.69 and 1.61 and exhibit low, and therefore the formability is bad.

On the other hand, in case of conventional steel, $\bar{r}$ value is 1.92 and the formability is good level, and the adding amount of titanium and nitrogen is sufficient, due to a sufficient precipitates of titanium nitride, the fishscale generating number is 2 under severe condition, and it is judged that the fishscale generation is none under ordinary enviromental condition, but there would be a possibility for occurring the fishscale defect under wet environmental condition as summer season. Particularly, in case of conventional steel 16, the enamel adherence index is 55 and exhibits very low, and this is because the titanium content is higher than a range of the present invention and the content of sulfur is lower than a range of the present invention.

INDUSTRIAL APPLICABILITY

As described above, the present invention is very much useful for the enamel coating product manufacture such as tableware, bathtub, construction panel, external plate material of microwave oven or gas range by providing an enamel coated cold rolled steel plate being excellent in enamel adherence and formability by pertinently controlling the composition of aluminum killed steel and pertinently controlling a manufacturing condition, particularly the cold rolling.

We claim:

1. In a method for manufacturing an enameling cold rolled steel plate by utilizing aluminum killed steel, a method for manufacturing a cold rolled steel plate having excellent enamel adherence properties, comprising the steps:

providing an aluminum killed steel in which C: less than 0.01%, Mn: 0.1–0.4%, S: 0.03–0.09%, Ti: 0.04–0.1% and N: less than 0.01% by weight % are contained, wherein an atomic ratio defined by Ti/(C+N+0.4S) is adjusted to 1.0–2.0, and a balance being Fe and other inevitable impurities, hot rolling, including a finish rolling to be finished at a temperature greater than art $Ar_3$ transformation temperature, coiling, cold rolling at a reduction ratio of 50–85%, and then continuously annealing.

2. A method for manufacturing a high processing cold rolled steel plate being excellent in enamel adherence as defined in claim 1, wherein a content of S is 0.06–0.08%, and a content of Ti is 0.06–0.08%.

3. A method for manufacturing a high processing cold rolled steel plate being excellent in enamel adherence as defined in claim 1, wherein a coiling temperature is 600°–7000° C., and a continuous annealing temperature and a time are respectively 800°–850° C. and 30 seconds–10 minutes.

4. A method for manufacturing a high processing cold rolled steel plate being excellent in enamel adherence as defined in claim 3, wherein said continuous annealing time is 1–5 minutes.

5. A method for manufacturing a high processing cold rolled steel plate being excellent in enamel adherence as defined in claim 2, wherein a coiling temperature is 600°–700° C., and a continuous annealing temperature and a time are respectively 800°–850° C. and 30 seconds–10 minutes.

6. A method for manufacturing a high processing cold rolled steel plate being excellent in enamel adherence as defined in claim 5, wherein said continuous annealing time is 1–5 minutes.

* * * * *

UNITED STATES PATENT AND TRADEMARK OFFICE

CERTIFICATE OF CORRECTION

PATENT NO. : 5,738,738

DATED : April 14, 1998

INVENTOR(S) : Jeong Bong Yoon and Sung Ju Kim

It is certified that error appears in the above-identified patent and that said Letters Patent is hereby corrected as shown below:

Claim 1 Column 8 Line 10 "greater than art" should read --greater than an--.

Claim 3 Column 8 Line 20 "600-7000°C" should read --600-700°C--.

Signed and Sealed this

Eleventh Day of August 1998

Bruce Lehman

*Attest:*

BRUCE LEHMAN

*Attesting Officer*

*Commissioner of Patents and Trademarks*